US007441498B2

(12) United States Patent
Iwamoto et al.

(10) Patent No.: US 7,441,498 B2
(45) Date of Patent: Oct. 28, 2008

(54) IMAGE FORMING SYSTEM

(75) Inventors: Manabu Iwamoto, Ami-machi (JP); Kenji Oshima, Ami-machi (JP)

(73) Assignee: Riso Kagaku Corporation, Tokyo (JP)

( * ) Notice: Subject to any disclaimer, the term of this patent is extended or adjusted under 35 U.S.C. 154(b) by 333 days.

(21) Appl. No.: 10/546,550

(22) PCT Filed: Dec. 15, 2003

(86) PCT No.: PCT/JP03/16045

§ 371 (c)(1),
(2), (4) Date: Aug. 23, 2005

(87) PCT Pub. No.: WO2004/073992

PCT Pub. Date: Sep. 2, 2004

(65) Prior Publication Data

US 2006/0150833 A1 Jul. 13, 2006

(30) Foreign Application Priority Data

Feb. 24, 2003 (JP) ..... 2003-045566

(51) Int. Cl.
*B41L 13/00* (2006.01)
*B41C 1/14* (2006.01)

(52) U.S. Cl. ..... 101/119; 101/128.4

(58) Field of Classification Search ..... 101/116, 101/119, 120, 127.1, 128.4, 129
See application file for complete search history.

(56) References Cited

U.S. PATENT DOCUMENTS 5,220,352 A * 6/1993 Yamamoto et al. ..... 347/214
5,755,519 A * 5/1998 Klinefelter ..... 400/249
5,767,943 A * 6/1998 Oberhardt et al. ..... 355/18
6,042,284 A * 3/2000 Yanagisawa et al. ..... 400/615.2
6,099,178 A * 8/2000 Spurr et al. ..... 700/207
6,530,519 B1 3/2003 Suzuki
6,971,732 B1 * 12/2005 Seshimo et al. ..... 347/19

FOREIGN PATENT DOCUMENTS

| | | |
|---|---|---|
| JP | 4133746 | 5/1992 |
| JP | 2001018507 | 1/2001 |
| JP | 2001341290 | 12/2001 |
| JP | 2002234156 | 8/2002 |

* cited by examiner

*Primary Examiner*—Ren Yan
(74) *Attorney, Agent, or Firm*—Matthew K. Ryan; Frommer Lawrence & Haug LLP

(57) ABSTRACT

An image forming system includes a mounting portion in which an expendable provided with a memory in which distinguishment information representing whether the expendable is compatible is stored is removably installed. The distinguishment information stored in the memory of the expendable installed in the mounting portion is read out, and operation of a predetermined object is controlled on the basis of a control information according to the distinguishment information when the distinguishment information read out represents that the expendable is compatible. A control information input mechanism for inputting control information of the object when the distinguishment information read out represents that the expendable is incompatible is further provided and the operation of the object is controlled on the basis of the control information input by the control information input mechanism when the distinguishment information read out from the memory of the expendable represents that the expendable is incompatible.

11 Claims, 5 Drawing Sheets

IMAGE FORMING SYSTEM

FIELD OF THE INVENTION

This invention relates to an image forming system which is installed with an expendable having a storage means in which distinguishment information representing whether the expendable is a compatible product is stored and is controlled to form an image on the basis of the distinguishment information.

BACKGROUND OF THE INVENTION

There have been used expendables in various image forming systems such as a stencil printer, an ink jet recording system and the like for the reason of easiness in handling or the like. For example, in the stencil printer, an expendable such as a removable ink container or a stencil material roll is employed for the reason of easiness in handling or the like. Further, also in the ink jet recording system, a removable ink container is employed. The above-mentioned expendables are generally installed on the system body to supply the ink or the stencil material to the part in necessity and then are removed when the ink or the stencil material is exhausted to be discarded or to be recycled. When a new expendable is mounted on the stencil printer thereafter, it becomes possible to continuously make print.

In order to suitably carry out an image formation by the use of such expendables, it is necessary to use expendables compatible to the function and/or the characteristics of the system body. When an expendable incompatible to the system body is used, a suitable image formation is impossible and/or the system body or the expendable can come to fail. Accordingly, in order to prevent the use of incompatible product by accident, the shape of the ink container or the diameter of the paper core of the stencil material roll is conventionally made peculiar to the system so that it is physically impossible to install the system with incompatible expendables. However, it is troublesome to manage the expendables when the shape of the ink container or the diameter of the paper core of the stencil material roll is thus changed by the kind of the system. Accordingly, in Japanese Unexamined Patent Publication Nos. 2001-18507 and 2001-341290, there has been proposed an expendable provided with a storage means such as a memory IC in which distinguishment information representing whether the expendable is a compatible product is stored. Whether the expendable installed is compatible is determined on the basis of the distinguishment information read out from the storage means of the expendable, and when the expendable is incompatible, the system body is inhibited from being operated.

However, when the system body is inhibited from being operated if the expendable installed to the system body is incompatible, it is necessary to interrupt printing until the operator obtains a compatible expendable, which largely deteriorates the printing efficiency.

In view of the foregoing observations and description, the primary object of the present invention is to provide an image forming system which permit continuous printing even if an incompatible expendable is installed in the system body in those which are installed with an expendable provided with a storage means in which distinguishment information representing whether the expendable is a compatible product is stored and are controlled to form an image on the basis of the distinguishment information.

SUMMARY OF THE INVENTION

In accordance with the present invention, there is provided an image forming system comprising a mounting portion in which an expendable provided with a storage means in which distinguishment information representing whether the expendable is a compatible product is stored is removably installed, a read out means which reads out the distinguishment information stored in the storage means of the expendable installed in the mounting portion, and a control means which controls operation of a predetermined object to be controlled operation of which is to be controlled in relation to the expendable on the basis of a control information according to the distinguishment information when the distinguishment information read out by the read out means represents that the expendable is a compatible product, whereby the predetermined object to be controlled is caused to operate by the control means to form an image on the basis of the control information according to the distinguishment information, wherein the improvement comprises that a control information input means for inputting control information of the object to be controlled when the distinguishment information read out from the storage means of the expendable by the read out means represents that the expendable is an incompatible product is further provided and the control means controls the operation of the object to be controlled on the basis of the control information input by the control information input means when the distinguishment information read out from the storage means of the expendable represents that the expendable is an incompatible product.

The "compatible product" refers to an expendable compatible to those peculiar to the system, e.g., the function and/or the characteristics of the system. The "incompatible product" refers to an expendable incompatible to those peculiar to the system. The conditions under which the "compatible product" and the "incompatible product" are distinguished can be set in advance in the system.

The "distinguishment information" may be any so long as whether or not the expendable is a compatible product can be distinguished. For example, the "distinguishment information" may be information representing the kind of the system and/or the kind of the expendable or a parameter used in operation of the system. Such parameter includes, for instance, the amount of energy of the thermal head suitable for the stencil material in the case where the expendable is a stencil material roll, or the color or the viscosity of ink filled in the ink container when the expendable is an ink container. Further, when the distinguishment information is information representing the kind of the system, the kind of the system represented by the distinguishment information is compared with that represented by the information on the kind of the system which has been set in advance in the system, and when the former conforms to the latter, it is determined that the expendable is a compatible product, whereas when the former does not conform to the latter, it is determined that the expendable is an incompatible product. When the distinguishment information is a parameter, the parameter represented by the distinguishment information is compared with that represented by the information on the parameter which has been set in advance in the system, and when the former conforms to the latter, it is determined that the expendable is a compatible product, whereas when the former does not conform to the latter, it is determined that the expendable is an incompatible product. Further, when the distinguishment information is a parameter, it is possible to compare the value of the parameter represented by the distinguishment information with the range of the parameter represented by the information on the parameter which has been set in advance in the system, and when the former is in the range of the latter, it is determined that the expendable is a compatible product, whereas when the former is not in the range of the latter, it is determined that the expendable is an incompatible product.

Further, "a predetermined object to be controlled operation of which is to be controlled in relation to the expendable" may be any so long as it is controlled on the basis of the characteristics or the like of the expendable. For example, when the expendable is a stencil material roll, it may be a thermal head which is controlled on the basis of the kind of the stencil material of the stencil material roll, and when the expendable is an ink container, it may be a press roller which is controlled so that the printing pressure is according to the viscosity of the ink filled in the ink container, or a printing interrupting means which determines whether the printing drum to be installed in the system according to the color of the ink filled in the ink container is of a color conforming to the color of the ink and interrupts printing when the former does not conform to the color of the ink.

The "control information according to the distinguishment information" means, when the distinguishment information represents that the expendable is a compatible product, a control information according to, for instance, the characteristics of the compatible product, and when the distinguishment information represents that the expendable is an incompatible product, a control information according to, for instance, the characteristics of the incompatible product. The "distinguishment information" may be the same as the "control information". For example, the heating energy of the thermal head or the printing pressure by the press roller may used as both the "distinguishment information" and the "control information".

Further, the "control information" may be any so long as it is information for operating the "object to be controlled", For example, when the object to be controlled is the thermal head, it may be the heating energy of the thermal head, when the object to be controlled is the press roller, it may be the printing pressure by the press roller and when the object to be controlled is the printing interrupting means, it may be a control signal representing whether the printing is to be interrupted.

The "control information input means" may be an input means which can input a control information also when the expendable is a compatible product not only when the expendable is an incompatible product.

Further, in the image forming system, the control means may wait for, when the distinguishment information read out from the storage means of the expendable represents that the expendable is an incompatible product, input of the control information by the control information input means, and then control operation of the object to be controlled on the basis of the control information input after input of the control information by the control information input means.

Further, the image forming system may be provided with a display means which, when the distinguishment information read out from the storage means of the expendable represents that the expendable is an incompatible product, displays an initial control information which has been set in advance.

The "initial control information which has been set in advance" includes, for instance, when the control information is the heating energy of the thermal head or the printing pressure by the press roller, a minimum value of the same but may be a median.

Further, the image forming system may be provided with a display means which, when the distinguishment information read out from the storage means of the expendable represents that the expendable is an incompatible product and at the same time when a control information according to the distinguishment information read out can be read out from the storage means, displays the control information according to the distinguishment information.

Further, the image forming system may be provided with a display means which displays the distinguishment information stored in the storage means.

Further, in the image forming system, the control information input means may be an input means which can input only a part of a plurality of pieces of control information.

In the image forming system of the present invention since the object to be controlled is controlled on the basis of the control information input by the control information input means when the distinguishment information read out from the storage means of the expendable represents that the expendable is an incompatible product, printing can be continued even when an incompatible product is installed in the system body.

Further, when input of the control information by the control information input means is waited for when the distinguishment information read out from the storage means of the expendable represents that the expendable is an incompatible product in the image forming system described above, and then operation of the object to be controlled is controlled on the basis of the control information input after input of the control information by the control information input means, a suitable image formation can be carried out by the operator inputting suitable control information.

Further, when an initial control information which has been set in advance is displayed if the distinguishment information read out from the storage means of the expendable represents that the expendable is an incompatible product in image forming system described above, a more suitable image formation can be carried out by the operator inputting more suitable control information on the basis of the displayed initial control information which has been set in advance. Further, when safer information is set as the initial control information, influence on the system body and/or the expendable can be less.

Further, when, if the distinguishment information read out from the storage means of the expendable represents that the expendable is an incompatible product and at the same time if a control information according to the distinguishment information read out can be read out from the storage means, the control information according to the distinguishment information is displayed, a more suitable image formation can be carried out by the operator inputting more suitable control information on the basis of the displayed control information which has been read out from the storage means.

Further, when the distinguishment information stored in the storage means is displayed by the display means, the operator can input suitable control information according to the distinguishment information after ascertaining the displayed distinguishment information.

Further, when the control information input means is an input means which can input only a part of a plurality of pieces of control information, the labor of the operator of inputting the control information can be reduced by making the control information input means able to input only control information which largely affects image formation and/or the system.

PREFERRED EMBODIMENTS OF THE INVENTION

Figure 1:
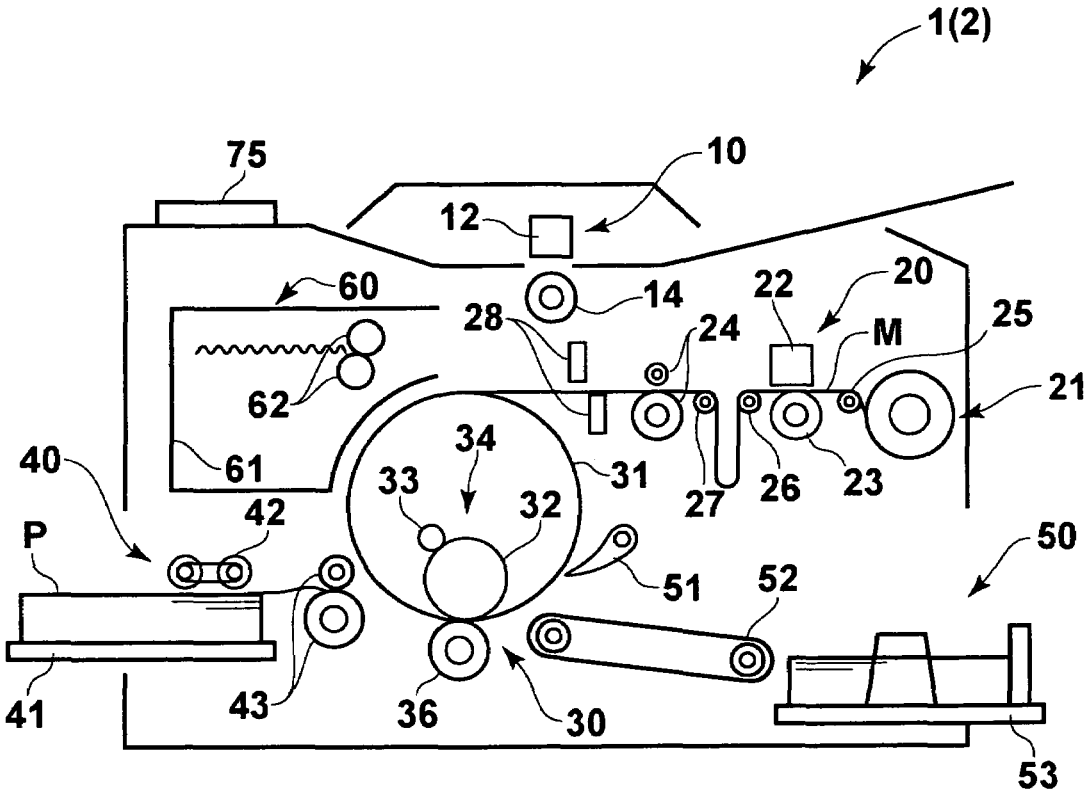
FIG. 1 is a view showing in brief a stencil printer employing an image forming system in accordance with first and second embodiments of the present invention.

A stencil printer using an image forming system in accordance with a first embodiment of the present invention will be described, hereinbelow, with reference to the drawings. FIG. 1 is a view showing in brief the stencil printer 1.

As shown in FIG. 1, the stencil printer 1 comprises an image reading portion 10 which reads out an image on an original, a stencil making portion 20 which makes a stencil from stencil material M on the basis of the image information read by the image reading portion 10, a printing portion 30 which prints on a printing paper by the use of the stencil made by the stencil making portion 20, a paper supply portion 40 which supplies the printing paper to the printing portion 30, a paper discharge portion 50 which discharges the printed printing paper from the printing portion 30, and a stencil discharge portion 60 which discharges the stencil after use.

The image read-out portion 10 is an image scanner and comprises an image line sensor 12 which reads out an image on an original conveyed in a sub-scanning direction, and original feed rollers 14.

The stencil making portion 20 comprises a stencil material roll portion 21, a thermal head 22 where plurality of heater elements are arranged in a row, stencil material feed rollers 23 and 24, stencil material guide rollers 25, 26 and 27, and a stencil cutter 28.

The printing portion 30 comprises a cylindrical ink-transmittable printing drum 31 which is formed of a porous metal plate or a mesh structure, an ink supply system 34 having a squeegee roller 32 and a doctor roller 33 and an ink supply pump 35 (FIG. 2) which are disposed inside the printing drum 31, and a press roller 36. The stencil is wound around outer periphery of the printing drum 31.

Figure 2:
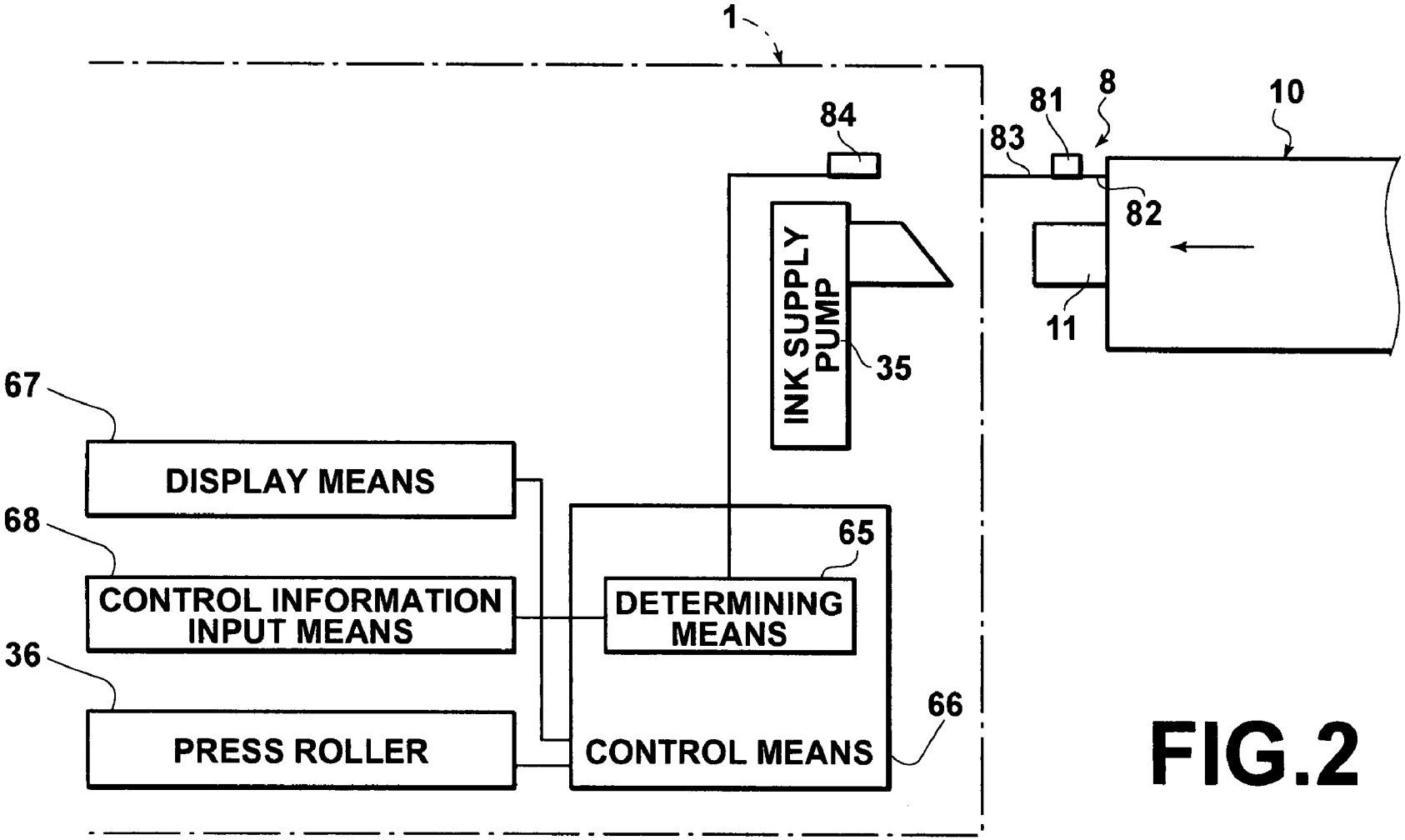
FIG. 2 is a block diagram of a part of the stencil printer employing an image forming system in accordance with the first embodiment of the present invention.

The ink container 10 in which ink to be used in the printing portion 30 is provided at its leading end with an opening 11 through which the ink is discharged as shown in FIG. 2. The opening 11 is connected to an ink supply pump 35 disposed inside the printing drum 31. The ink container 10 is provided at its leading end portion a storage means 8 which stores predetermined information representing. The storage means 8 comprises a memory IC 81 forming a non-volatile memory (e.g., an EEPROM) which can hold data for a predetermined time without power supply, and a contact 83 is provided on the tip of a board 82 on which the memory IC 81 is mounted. Kind information representing the kind of the system to which the ink container is compatible and viscosity information representing the viscosity of ink filled in the ink container 10 are stored in the memory IC 81 of the storage means 8.

Further, as shown in FIG. 2, a connector 84 which is to be electrically connected to the contact 83 of the storage means 8 of the ink container 10 is provided near the ink supply pump 35 of the stencil printer 1. The connector 84 and a determining means 95 (to be described later) are connected to each other so that the kind information and the ink viscosity information stored in the storage means 8 are read out by the determining means 95.

The paper supply portion 40 comprises a paper supply table 41 on which printing papers P are stacked, a pair of pick-up rollers 42 which take out the printing papers P one by one from the paper supply table 41, and a pair of timing rollers 43 which sends a printing paper P between the printing drum 31 and the press roller 35.

The paper discharge portion 50 comprises a separator 51 which peels off printing paper P from the printing drum 31, a paper discharge belt portion 52, and a paper discharge table 53 on which the printed printing papers P are stacked.

The stencil discharge portion 60 comprises a stencil discharge box 61 which is disposed on one side of the printing portion 30 and in which the stencil peeled off the printing drum 31 is placed, and a pair of stencil discharge rollers 62 which peel the stencil off the printing drum 31 after use and convey the stencil peeled off the printing drum 31 into the stencil discharge box 61.

As shown in FIG. 2, the stencil printer 1 comprises a determining means 65 which obtains the system kind information from the storage means 8 and compares the system kind information read out from the storage means 8 with the system kind information which has been set in advance to determine whether the former conforms to the latter, a control means 66 which includes the determining means 65 and waits for, when the system kind information read out from the storage means 8 is different from the system kind information which has been set in advance, input of the information on the viscosity of ink by a control information input means 68 (to be described later) to control the press roller 36 to operate at a printing pressure according to the viscosity of ink input, a display means 67 which displays an alarm representing that it is determined that the system kind information read out from the storage means 8 is different from the system kind information which has been set in advance and the viscosity of ink, and the control information input means 68 which permits input of a predetermined ink viscosity information.

Figure 3:
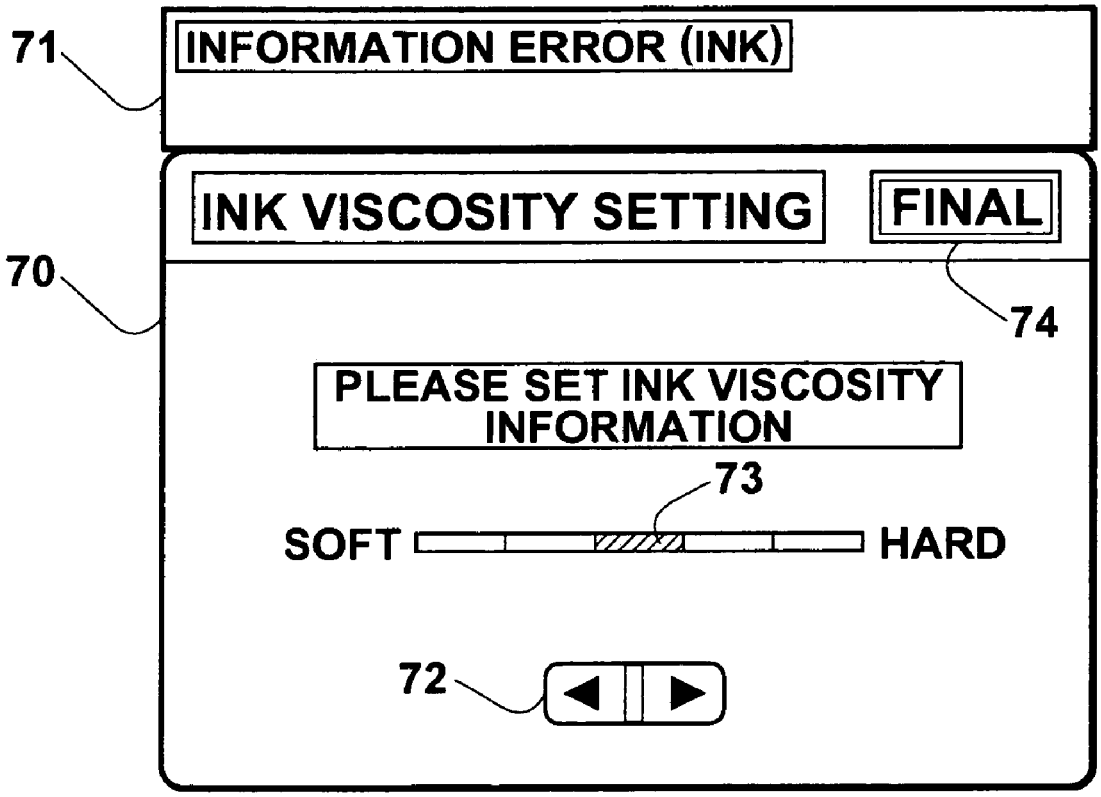
FIG. 3 is a view showing the display of the display means shown in FIG. 2.

The control means 66 stores a table in which the ink viscosity information and the printing pressure are linked each other. The control means 66 obtains the printing pressure by referring to the table on the basis of the input ink viscosity information, and outputs a control signal so that the press roller 36 operates at the printing pressure. The table is set so that as the ink viscosity information becomes larger, the printing pressure becomes higher. The control information input means 68 permits the operator to input ink viscosity information by causing the display means 67 to display an ink viscosity setting screen such as shown in FIG. 3 in which ink viscosity information can be set.

Operation of the stencil printer of this embodiment will be described, hereinbelow.

A stencil material roll 21*b* is first installed on the master holder 90 and the stencil material M is unrolled from the stencil material roll 21*b* in a length corresponding to one stencil which has been set in advance. The stencil material M unrolled from the stencil material roll 21*b* is thermally perforated by selectively energizing the heater elements of the thermal head 22 of the stencil making portion 20 and is cut by the stencil cutter 28 into a stencil. Then the stencil is wound around the printing drum 31.

Whereas, the ink container 10 is installed in the ink supply pump 35 of the ink supply system 34, whereby the contact 83 of the storage means 8 is electrically connected to the connector 84, and the system kind information and the ink viscosity information stored in the storage means 8 are read out by the determining means 65. The determining means 65 compares the input system kind information with the system kind information which has been set in advance and when the former does not conform to the latter, outputs to the display means 67 an information signal representing that the former does not conform to the latter. The display means 67 displays an error message on an alarm screen 71 as shown in FIG. 3 in response to receipt of the information signal.

The operator, when an error message is displayed on the alarm screen 71 of the display means 67, sets a predetermined ink viscosity information by pressing one of arrow buttons of an ink viscosity setting means 72 in an ink viscosity setting screen 70 to move a marker 73 to a predetermined position. The position of the marker 73 initially displayed may either be a predetermined position which has been set in advance or the position according to the ink viscosity information read out from the storage means 8. Further, the system information read out from the storage means 8 may be displayed together.

The ink viscosity information thus set by the operator is output from the control information input means 68 to the control means 66 in response to depression of a final button 74 in the ink viscosity setting screen 70. Further, it is possible to correct the ink viscosity information by depression of a reset key (not shown) on the system body even after the final button 74 is once depressed and the ink viscosity information is output to the control means 66.

The control means 66 sets the printing pressure by referring to the table on the basis of the ink viscosity information input in the manner described above, and controls the press roller 36 so that print is made at the set printing pressure.

By the ink supply system 34, ink of a predetermined color is supplied inside the printing drum 31. As the printing drum 31 is rotated in the counterclockwise direction as seen in FIG. 1, a printing paper P is moved left to right as seen in FIG. 1 by timing rollers 43 to be supplied between the printing drum 31 and the press roller 36 at a predetermined timing in synchronization with the rotation of the printing drum 31. The printing paper P is subsequently pressed by the press roller 36 against the stencil M on the outer peripheral surface of the printing drum 31 at the printing pressure controlled according to the manner described above, whereby the printing paper P is printed with the ink. When the determining means 65 determines that the system kind information read out from the storage means 8 is different from the system kind information which has been set in advance, the printing is not carried out until the operator sets a predetermined ink viscosity on the ink viscosity setting screen 70.

For example, when the density of an image printed at a printing pressure controlled in the manner described above is thin, it is necessary to print at a higher printing pressure. Accordingly, the operator depresses the right arrow button of the ink viscosity setting means 72 in the ink viscosity setting screen 70 to move rightward the marker 73 and increase the ink viscosity information. The ink viscosity information thus set is output from the control information input means 68 to the control means 66 in response to depression of the final button 74 in the ink viscosity setting screen 70. The control means 66 sets the printing pressure by referring to the table on the basis of the ink viscosity information input in the manner described above, and controls the press roller 36 so that print is made at the set printing pressure.

When the printed image is thick in reverse to the case described above, it is necessary to print at a lower printing pressure. Accordingly, the operator depresses the left arrow button of the ink viscosity setting means 72 in the ink viscosity setting screen 70 to move leftward the marker 73 and decrease the ink viscosity information. The ink viscosity information thus set is output from the control information input means 68 to the control means 66 in response to depression of the final button 74 in the ink viscosity setting screen 70. The control means 66 sets the printing pressure by referring to the table on the basis of the ink viscosity information input in the manner described above, and controls the press roller 36 so that print is made at the set printing pressure.

The press roller 36 operates at the printing pressure set in the manner described above, and printing is carried out in the manner described above.

In accordance with the stencil printer 1, when the distinguishment information read out from the storage means 8 of an ink container 10 represents that the ink container 10 is an incompatible product, the printing pressure of the press roller 36 is controlled on the basis of the ink viscosity information input in the ink viscosity setting screen 70. Accordingly, continuous printing is permitted even if an incompatible product is installed in the system body.

In the first embodiment described above, when the determining means 65 determines that the system kind information read out from the storage means 8 is different from the system kind information which has been set in advance, the control means 66 waits for input of the ink viscosity information by the operator, and then controls the press roller 36 to print at a printing pressure according to the ink viscosity information input after input of the ink viscosity information. However, printing may be carried out at a printing pressure which has been set in the control means 66 as an initial value before the ink viscosity information is input by the operator, and then the operator may subsequently set the ink viscosity information on the ink viscosity setting screen 70 viewing the density of the printed image. It is preferred that the initial value be the lowest printing pressure in the printing pressures which can be set in the stencil printer.

In the first embodiment described above, printing may be carried out at a printing pressure according to the ink viscosity information stored in the storage means 8 without waiting for input of the ink viscosity information by the operator and the operator may subsequently set the ink viscosity information on the ink viscosity setting screen 70 viewing the density of the printed image.

Further, though, in the first embodiment described above, the density of the printed image is controlled by controlling the printing pressure according to the ink viscosity information, the density of the printed image may be controlled by controlling not the printing pressure but the printing speed, that is, the rotational speed of the printing drum 31 according to the ink viscosity information.

Further, though, in the first embodiment described above, when an incompatible ink container 10 is installed in the stencil printer 1, suitable ink viscosity information is input by the control information input means 68 and the press roller 36 is controlled to operate at a printing pressure according to the ink viscosity information, a so-called inkless time may be controlled on the basis of the ink viscosity information input by the control information input means 68. The "inkless time" is employed to recognize that the ink container is exhausted. For example, in the stencil printer described above, it is recognized that the ink container is exhausted when an ink sensor detects that the amount of ink temporarily stored in an ink fountain is reduced smaller than a predetermined amount and the amount of ink in the ink fountain does not reach a predetermined amount if the ink supply pump is thereafter operated for a predetermined time (inkless time). When the ink viscosity information differs, the amount of ink supplied from the ink supply pump per unit time. Accordingly, it is necessary to set the inkless time according to the ink viscosity information.

When an incompatible ink container 10 different in ink viscosity information is installed in the stencil printer 1, a suitable inkless time cannot be set and that the ink container is exhausted can be detected by mistake. Accordingly, when an incompatible ink container 10 is installed in the stencil printer 1, detection that the ink container is exhausted by mistake can be avoided by inputting a suitable inkless time by the control information input means 68 and controlling the inkless time on the basis of the ink viscosity information.

A stencil printer using an image forming system in accordance with a second embodiment of the present invention will be described, hereinbelow.

The stencil printer 2 is substantially the same as the stencil printer 1 of the first embodiment shown in FIG. 1 except that in the stencil material roll portion 21, a stencil material roll 21*b* comprising stencil material M in a continuous length wound around a paper core 21*a* is mounted on a master holder 90 to be changeable as shown in FIG. 2. A storage means 9 which stores a predetermined information is disposed in a support member 21*c* mounted for rotation on one end portion of the paper core 21*a*. The storage means 9 comprises a memory IC 91 forming a non-volatile memory (e.g., an EEPROM) which can hold data for a predetermined time without power supply, and a contact 93 is provided on the tip of a board 92 on which the memory IC 91 is mounted. In the memory IC 91 of the storage means 9, a system kind information representing the kind of the system to which the stencil material roll 21*b* is compatible and energy data on the amount of energy of the thermal head 22 according to the amount of heat provided to the stencil material M of the stencil material roll 21*b* are stored. Further, as shown in FIG. 2, a connector 94 to be electrically connected to the contact 93 of the storage means 9 of the stencil material roll 21*b* is disposed in the master holder 90.

Figure 4:
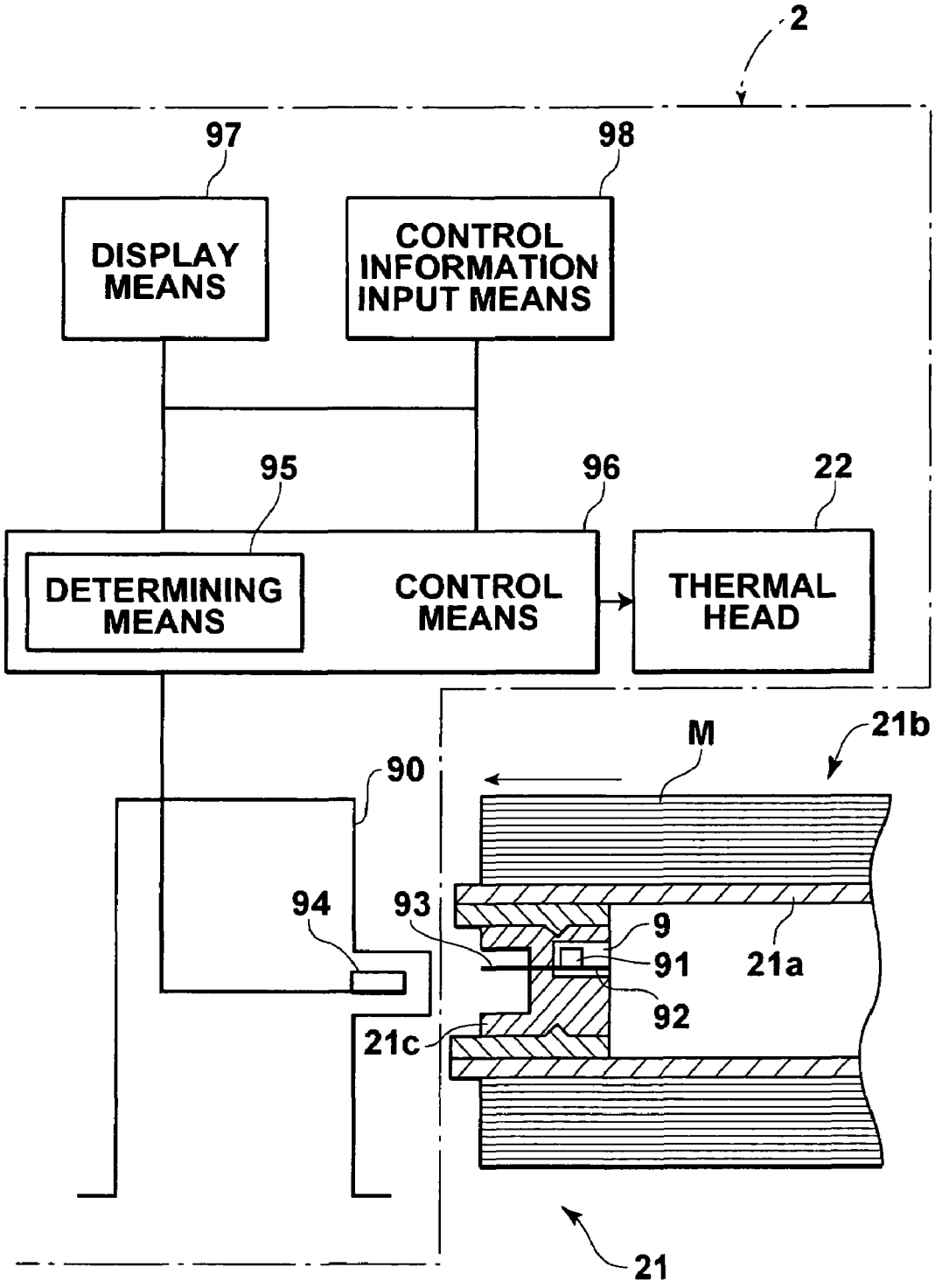
FIG. 4 is a block diagram of a part of the stencil printer employing an image forming system in accordance with the second embodiment of the present invention.

As shown in FIG. 4, the stencil printer 2 comprises a determining means 95 which obtains the system kind information from the storage means 9 provided on the stencil material roll 21*b* and compares the system kind information read out from the storage means 9 with the system kind information which has been set in advance to determine whether the former conforms to the latter, a control means 96 which includes the determining means 95 and, when the system kind information read out from the storage means 9 is different from the system kind information which has been set in advance, controls the thermal head 22 to generate heat at an amount of energy input by a control information input means 98 (to be described later), a display means 97 which displays an alarm representing that it is determined that the system kind information read out from the storage means 9 is different from the system kind information which has been set in advance and the amount of energy to the thermal head 22, and the control information input means 98 which permits input of a predetermined amount of energy.

Figure 5:
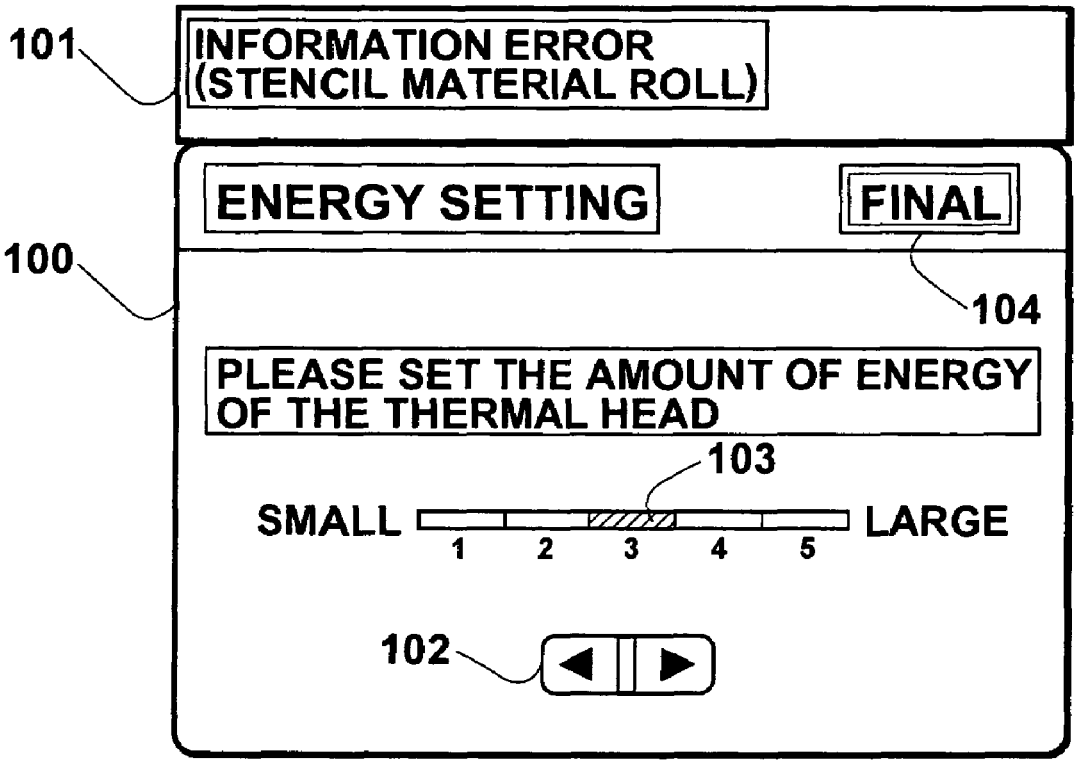
FIG. 5 is a view showing the display of the display means shown in FIG. 4.

The control information input means 98 permits the operator to input an amount of energy by causing the display means 97 to display an energy setting screen 100 such as shown in FIG. 5 in which energy information can be set.

Operation of the stencil printer of this embodiment will be described, hereinbelow.

A stencil material roll 21*b* is first installed on the master holder 90 and the stencil material M is unrolled from the stencil material roll 21*b* in a length corresponding to one stencil which has been set in advance. The stencil material M unrolled from the stencil material roll 21*b* is guided to between the platen roller 23 and the thermal head 22 by the stencil guide 25.

In response to installment of the stencil material roll 21*b* on the master holder 90, the connector 94 on the master holder 90 is electrically connected to the contact 93 of the storage means 9 provided on the stencil material roll 21*b*, whereby a system kind information and energy information which are stored in the storage means 9 is read out by the determining means 95. The determining means 95 compares the input system kind information with the system kind information which has been set in advance and when the former does not conform to the latter, outputs to the display means 97 an information signal representing that the former does not conform to the latter. The display means 97 displays an error message on an alarm screen 101 as shown in FIG. 5 in response to receipt of the information signal.

The operator, when an error message is displayed on the alarm screen 101 of the display means 97, sets a predetermined amount of energy by pressing one of arrow buttons of an energy setting means 102 in an energy setting screen 100 to move a marker 103 to a predetermined position. The position of the marker 103 initially displayed may either be a predetermined position which has been set in advance or the position according to the amount of energy read out from the storage means 9. Further, the system kind information read out from the storage means 9 may be displayed together.

The amount of energy thus set by the operator is output from the control information input means 98 to the control means 96 in response to depression of a final button 104 in the energy setting screen 100. Further, it is possible to correct the amount of energy by depression of a reset key (not shown) on the system body even after the final button 104 is once depressed and the amount of energy is output to the control means 96.

The control means 96 controls the thermal head 22 to generate heat at an amount of energy thus input. The stencil making is not carried out until the operator sets a predetermined amount of energy on the energy setting screen 100 when the determining means 95 determines that the system kind information read out from the storage means 8 is different from the system kind information which has been set in advance.

The stencil material M guided to between the platen roller 23 and the thermal head 22 is pressed against the thermal head 22 by the platen roller 23 and at the same time conveyed by rotation of the platen roller 23. The stencil material M is thermally perforated by the thermal head 22 the amount of energy of which is controlled in the manner described above and conveyed to the stencil cutter 28 by the stencil material guide rollers 26 and 27 and the stencil material feed rollers 24. Then the stencil material M is cut by the stencil cutter 28 into a stencil and the stencil is wound around the printing drum 31.

Ink and the printing paper P are supplied in the same manner as in the first embodiment described above, and the printing paper P is pressed by the press roller 36 against the stencil M on the outer peripheral surface of the printing drum 31 at a predetermined printing pressure, whereby the printing paper P is printed with the ink.

When perforations of the stencil material M by the amount of energy of the thermal head 22 controlled in the manner described above is insufficient, it is necessary to make a stencil at a larger amount of energy. Accordingly, the operator depresses the right arrow button of the energy setting means 102 in the energy setting screen 100 to move rightward the marker 103 and increase the amount of energy. The amount of energy thus set is output from the control information input means 98 to the control means 96 in response to depression of the final button 104 in the energy setting screen 100. The control means 96 controls the thermal head 22 to generate heat at an amount of energy thus input.

Conversely, when perforations of the stencil material M made is excessive, it is necessary to make a stencil at a smaller amount of energy. Accordingly, the operator depresses the left arrow button of the energy setting means 102 in the energy setting screen 100 to move leftward the marker 103 and increase the amount of energy. The amount of energy thus set is output from the control information input means 98 to the control means 96 in response to depression of the final button 104 in the energy setting screen 100. The control means 96 controls the thermal head 22 to generate heat at an amount of energy thus input.

The thermal head 22 generates heat at an amount of energy thus input, and stencil making is carried out to make a stencil in the manner described above.

In accordance with the stencil printer 2, when the distinguishment information read out from the storage means 9 of a stencil material roll 21*b* represents that the stencil material roll 21*b* is an incompatible product, the amount of energy of the thermal head 22 is controlled on the basis of the amount of energy input in the energy setting screen 100. Accordingly, continuous printing is permitted even if an incompatible product is installed in the system body.

In the second embodiment described above, when the determining means 95 determines that the system kind information read out from the storage means 9 is different from the system kind information which has been set in advance, the control means 96 waits for input of the amount of energy by the operator, and then controls the thermal head 22 to generate heat at an amount of energy thus input. However, stencil making may be carried out at an amount of energy which has been set in the control means 96 as an initial value before the amount of energy is input by the operator, and then the operator may subsequently set the amount of energy on the energy setting screen 100 viewing the perforations of the stencil made. It is preferred that the initial value be the lowest printing pressure in the printing pressures which can be set in the stencil printer.

In the second embodiment described above, stencil making may be carried out at an amount of energy stored in the storage means 9 without waiting for input of the amount of energy by the operator and the operator may subsequently set the amount of energy on the energy setting screen 100 viewing the perforations of the stencil made.

Further, though, in the first and second embodiments described above, only the ink viscosity information and/or the amount of energy is displayed by the display means, other pieces of control information may be displayed. In this case, it is preferred that only control information such as the ink viscosity information or the amount of energy which largely affects image formation and/or the system be able to be input.

Further, the image forming system of the present invention may be applied also to an ink jet recording system. For example, when an ink cartridge incompatible to the ink jet recording system is installed in the ink jet recording system, a control information is input by the control information input means as in the stencil printer, and the printing is carried out on the basis of the input control information. The control information may be any so long as it is necessary to change its conditions according to viscosity information on the ink in the cartridge, and may include a color correction table, a voltage to be applied to the system to discharge the ink or a conveying time for the paper feed.

The invention claimed is:

1. A stencil printer comprising:

a printing drum around which a stencil is wound;

a press roller which is pressed against the printing drum;

a mounting portion in which an ink container which is filled with ink and is provided with a storage means in which distinguishing information representing whether the ink container is a compatible product is stored is removably installed;

a read out means which reads out the distinguishing information stored in the storage means of the ink container installed in the mounting portion and a control means which controls operation of the press roller on the basis of a control information according to the distinguishing information when the distinguishing information read out by the read out means represents that the ink container is a compatible product; and a control information input means that enables an operator to input control information of the press roller when the distinguishing information read out from the storage means of the ink container by the read out means represents that the ink container is an incompatible product is further provided, wherein the control means controls the printing pressure of the press roller on the basis of the control information input by the control information input means when the distinguishing information read out from the storage means of the ink container represents that the ink container is an incompatible product.

2. A stencil printer comprising:

a thermal head which perforates stencil material to make a stencil;

a printing drum around which the stencil is wound;

a mounting portion in which a stencil material roll which comprises the stencil material rolled into a roll and is provided with a storage means in which distinguishing information representing whether the stencil material roll is a compatible product is stored is removably installed;

a read out means which reads out the distinguishing information stored in the storage means of the stencil material roll installed in the mounting portion;

a control means which controls the amount of energy of the thermal head on the basis of a control information according to the distinguishing information when the distinguishing information read out by the read out means represents that the stencil material roll is a compatible product; and a control information input means that enables an operator to input control information of the thermal head when the distinguishing information read out from the storage means of the stencil material roll by the read out means represents that the stencil material roll is an incompatible product is further provided, wherein the control means controls the amount of energy of the thermal head on the basis of the control information input by the control information input means when the distinguishing information read out from the storage means of the stencil material roll represents that the stencil material roll is an incompatible product.

3. An image forming system comprising:

a mounting portion in which an expendable apparatus is provided with a storage means in which distinguishing information representing whether the expendable apparatus is a compatible product is stored is removably installed;

a read out means which reads out the distinguishing information stored in the storage means of the expendable apparatus installed in the mounting portion;

a control means which controls operation of a predetermined object to be controlled operation of which is to be controlled in relation to the expendable apparatus on the basis of control information according to the distinguishing information when the distinguishing information read out by the read out means represents that the expendable apparatus is a compatible product, whereby the predetermined object to be controlled is operated by the control means to form an image on the basis of the control information according to the distinguishing information; and a control information input means that enables an operator to input control information of the object to be controlled when the distinguishing information read out from the storage means of the expendable apparatus by the read out means represents that the expendable apparatus is an incompatible product, wherein the control means controls the operation of the object to be controlled on the basis of the control information input by the control information input means when the distinguishing information read out from the storage means of the expendable apparatus represents that the expendable apparatus is an incompatible product.

4. The image forming system as defined in claim 3 wherein the control means waits for, when the distinguishing information read out from the storage means of the expendable apparatus represents that the expendable apparatus is an incompatible product, input of the control information by the control information input means, and wherein the control means controls operation of the object to be controlled on the basis of the control information.

5. The image forming system as defined in claim 4 further comprising:

a display means which, when the distinguishing information read out from the storage means of the expendable apparatus represents that the expendable apparatus is an incompatible product, displays an initial control information which has been set in advance.

6. The image forming system as defined in claim 4 further comprising:

a display means which, when the distinguishing information read out from the storage means of the expendable apparatus represents that the expendable apparatus is an incompatible product and at the same time when a control information according to the distinguishing information read out can be read out from the storage means, displays the control information according to the distinguishing information.

7. The image forming system as defined in claim 3 further comprising a display means which, when the distinguishing information read out from the storage means of the expendable apparatus represents that the expendable apparatus is an incompatible product, displays an initial control information which has been set in advance.

8. The image forming system as defined in claim 3 further comprising:

a display means which, when the distinguishing information read out from the storage means of the expendable apparatus represents that the expendable apparatus is an incompatible product and at the same time when a control information according to the distinguishing information read out can be read out from the storage means, displays the control information according to the distinguishing information.

9. The image forming system as defined in claim 3 further comprising:

a display means which displays the distinguishing information stored in the storage means.

10. The image forming system as defined in claim 3 in which the control information input means inputs a part of a plurality of pieces of control information.

11. An image forming system as defined in claim 3 in which the storage means comprises a memory IC.

* * * * *